US012672667B2

(12) United States Patent
Di Giacomo et al.

(10) Patent No.: US 12,672,667 B2
(45) Date of Patent: Jul. 7, 2026

(54) RECOVERING NICOTINE FROM TOBACCO CURING

(71) Applicant: Philip Morris Products S.A., Neuchâtel (CH)

(72) Inventors: Michele Di Giacomo, Pully (CH); Claudia Berardi, Lausanne (CH); Manuel Salvador Carmona Franco, Ciudad Real (ES); Juan Francisco Rodríguez Romero, Carrión de Calatrava (ES); Krzysztof Wąs, Żyłka (PL)

(73) Assignee: Philip Morris Products S.A., Neuchatel (CH)

( * ) Notice: Subject to any disclaimer, the term of this patent is extended or adjusted under 35 U.S.C. 154(b) by 391 days.

(21) Appl. No.: 18/273,391

(22) PCT Filed: Jan. 27, 2022

(86) PCT No.: PCT/IB2022/050695

§ 371 (c)(1),
(2) Date: Jul. 20, 2023

(87) PCT Pub. No.: WO2022/162564

PCT Pub. Date: Aug. 4, 2022

(65) Prior Publication Data

US 2024/0108053 A1 Apr. 4, 2024

(30) Foreign Application Priority Data

Jan. 27, 2021 (EP) ..... 21153851

(51) Int. Cl.
*A24B 15/24* (2006.01)

(52) U.S. Cl.
CPC ..... *A24B 15/243* (2013.01)

(58) Field of Classification Search
CPC ..... A24B 15/243
See application file for complete search history.

(56) References Cited

U.S. PATENT DOCUMENTS 3,147,200 A 9/1964 Neel
4,153,063 A 5/1979 Roselius et al.
(Continued)

FOREIGN PATENT DOCUMENTS

CN 1064680 A 9/1992
CN 105111184 A 12/2015
(Continued)

OTHER PUBLICATIONS

European Search Report for EP 21153851.7 issued by the European Patent Office on Jul. 15, 2021; 9 pgs.
(Continued)

*Primary Examiner* — Michael H. Wilson
*Assistant Examiner* — Jennifer A Kessie
(74) *Attorney, Agent, or Firm* — Mueting Raasch Group

(57) ABSTRACT

A method for recovering concentrated nicotine from tobacco curing includes collecting a first aqueous solution including moisture released from tobacco during curing tobacco and including nicotine. The first aqueous solution is passed through a strong cation resin to sorb the nicotine. A second aqueous solution comprising ammonium hydroxide is passed through the resin to elute the nicotine and form a third aqueous solution comprising nicotine and ammonium hydroxide. The ammonium hydroxide is removed from the third aqueous solution to generate a fourth aqueous solution comprising nicotine. The fourth aqueous solution is incubated under conditions to cause the fourth aqueous solution to separate into a fifth aqueous solution comprising a first concentration of nicotine and a sixth aqueous solution comprising a second concentration of nicotine. The first
(Continued)

concentration of nicotine is greater than the second concentration of nicotine.

15 Claims, 6 Drawing Sheets

(56) References Cited

U.S. PATENT DOCUMENTS

| | | | |
|---|---|---|---|
| 9,004,074 | B2 | 4/2015 | Nauryzbaev et al. |
| 2013/0319434 | A1 | 12/2013 | Borschke et al. |

FOREIGN PATENT DOCUMENTS

| | | | |
|---|---|---|---|
| CN | 105985315 | A | 10/2016 |
| CN | 109224737 | A | 1/2019 |
| EP | 1176143 | A1 | 1/2002 |
| GB | 969 144 | A | 9/1964 |
| WO | WO 2013/180918 | A1 | 12/2013 |
| WO | WO 2019/239356 | A1 | 12/2013 |

OTHER PUBLICATIONS

International Search Report and Written Opinion for PCT/IB2022/050695, issued by the European Patent Office on Apr. 29, 2022; 10 pgs.

Bailey et al., "Dynamics and Microstructures of Nicotine/Water Binary mixtures near the Lower Critical Solution Temperature," *J of Phys Chem,* Oct. 18, 2018;122(41):9538-9548.

Davies (nee Edwards) et al., "The solubility loop of nicotine: water," *Transition Metal Chemistry* (Weinheim), Dec. 1, 2000; 628-629.

De Lucas et al., "Recovery of Nicotine from Aqueous Extracts of Tobacco wastes by an H +-Form Strong-Acid Ion Exchanger," *Industrial & Engineering Chem Research,* Dec. 1, 1998;37(12):4783-4791.

Speight, J., "Industrial Inorganic Chemistry," *Environmental Inorganic Chem for Engineers,* 2017; 13 pgs.

"Wastewater Technology Fact Sheet Ammonia Stripping," United States Environmental Protection Agency, Office of Water, Washington D.C., Sep. 2000; 4 pgs.

RECOVERING NICOTINE FROM TOBACCO CURING

This application is the § 371 U.S. National Stage of International Application No. PCT/IB2022/050695, filed 27 Jan. 2022, which claims the benefit of European Application No. 21153851.7, filed 27 Jan. 2021.

The present disclosure relates to processes and systems for recovering nicotine from tobacco curing processes.

Systems for collecting condensed liquid from tobacco curing barns are known. In addition, processes for extracting nicotine from condensed liquid are known. However, such processes tend to result in low concentrations of nicotine. In addition, such processes may result in substantial waste, which may include waste that may be difficult to dispose of in an environmentally friendly manner due to its chemical composition.

The present invention relates to processes and systems that provide for recovery of high concentrations of nicotine. The methods and systems may result in little or no waste. The main by-products of the methods may comprise water and fertilizer.

According to aspects of the present invention, there is provided a method for recovering concentrated nicotine from tobacco curing. The method comprises collecting a first aqueous solution comprising moisture released from curing tobacco, wherein the first aqueous solution comprises nicotine; passing the first aqueous solution through a strong cation resin to sorb the nicotine; passing a second aqueous solution comprising ammonium hydroxide through the resin to which the nicotine is sorbed to elute the nicotine from the resin and form a third aqueous solution comprising nicotine and ammonium hydroxide; removing ammonium hydroxide from the third aqueous solution to generate a fourth aqueous solution comprising nicotine; incubating the fourth aqueous solution at a temperature between 60 degrees Celsius and 210 degrees Celsius to cause the fourth aqueous solution to separate into a fifth aqueous solution comprising a first concentration of nicotine and a sixth aqueous solution comprising a second concentration of nicotine, wherein the first concentration of nicotine is greater than the second concentration of nicotine; and collecting the fifth aqueous solution to recover the concentrated nicotine.

The recovered nicotine may have a relatively high concentration. For example, fifth aqueous solution may comprise nicotine at concentrations of 70 percent by weight or greater, such as 75 percent by weight or greater. Such concentrations may be substantially higher than with previous process from recovering nicotine from tobacco curing processes.

The process may further comprise passing a seventh aqueous solution comprising nitric acid through the resin to regenerate the resin and elute the ammonium hydroxide and to generate an eighth aqueous solution comprising $NH_4NO_3$ (ammonium nitrate), which may be used as a fertilizer. Excess ammonium hydroxide may be removed by a stripping process. Removed ammonium hydroxide or ammonia may be reacted with excess nitric acid to generate additional ammonium nitrate. Very little waste may result. Water and ammonium nitrate, which may be used as a fertilizer, may be the major by-products associated with the recovery of nicotine.

According to aspects of the present invention, there is provided a system for recovering concentrated nicotine from tobacco curing. The system comprises a source of an aqueous solution comprising condensed moisture released from tobacco during curing, wherein the condensed moisture comprises nicotine. The system comprises an ion exchange column comprising a strong cation resin through which the aqueous solution comprising the condensed moisture may be passed to sorb the nicotine. The system comprises a first pump operatively coupled to a source of aqueous ammonium hydroxide and the ion exchange column and configured to pump the aqueous ammonium hydroxide through the strong cation resin to elute the nicotine from the resin. The system comprises a stripping apparatus configured to receive an aqueous solution comprising the nicotine and the ammonium hydroxide that has passed through the resin, wherein the stripping apparatus is operatively couplable to a source of gas, wherein the stripping apparatus and gas are configured to remove ammonia evolved from the ammonium hydroxide in the aqueous solution comprising the nicotine and the ammonium hydroxide, wherein the ammonia is carried away in a stream of the gas. The system comprises a thermostatic settler operably coupled to the stripping apparatus and configured to receive an aqueous solution exiting the stripping apparatus, wherein the aqueous solution exiting the stripping apparatus comprises the nicotine eluted from the ion exchange column from which the ammonium hydroxide has been removed in the stripping apparatus, wherein the thermostatic separator is configured to incubate the aqueous solution comprising the eluted nicotine from which the ammonium hydroxide has been removed at a temperature between 60 degrees Celsius and 210 degrees Celsius to cause separation of the incubated aqueous solution into an aqueous solution comprising a first concentration of nicotine and an aqueous solution comprising a second concentration of nicotine, wherein the first concentration of nicotine is greater than the second concentration of nicotine. The aqueous solution comprising the first concentration of nicotine may be collected to recover concentrated nicotine.

The system may comprise a condenser operatively coupled to the source of the aqueous solution comprising the condensed moisture. The condenser may be configured to condense the moisture released from the tobacco during a curing process.

The system may further comprise a second pump operably couplable to the ion exchange column and a source of an aqueous solution comprising nitric acid. The second pump may be configured to pump the aqueous solution comprising nitric acid through the strong cation resin, wherein the nitric acid elutes aqueous ammonia from the resin to regenerate the resin. The nitric acid reacts with the ammonium hydroxide to produce an aqueous solution comprising ammonium nitrate. The system may comprise a valve to direct flow direct flow of the aqueous solution comprising the ammonium nitrate to a by-product tank. The aqueous solution comprising ammonium nitrate may be used as a fertilizer.

The systems and processes of the present disclosure include collection of a first aqueous solution from a tobacco curing process. During curing, the tobacco loses a substantial amount of weight. Most of the weight loss is due to moisture loss. The moisture may comprise a small percentage of components other than water. For example, the moisture lost by tobacco during curing may comprise nicotine. Accordingly, collecting moisture lost from tobacco during a curing process may result in the collection of an aqueous solution comprising nicotine.

The first aqueous solution may be collected during any suitable curing process. For example, the first aqueous solution may be collected during a flue-curing process, an air-curing process, or a sun-curing process. Preferably, the first aqueous solution is collected during a flue-curing process.

In a sun-curing process, tobacco is cured by hanging leaves outside in the sun until the tobacco is suitably dried. For example, the tobacco may be hung outside for about two weeks. Due to difficulties in controlling conditions in an external environment and in collecting tobacco components released from sun curing, collection of the first aqueous solution during sun curing may be challenging.

In an air-curing process, tobacco is hung in a well-ventilated building, such as in a well-ventilated barn, to cure. The tobacco may be hung for a period of, for example, four to eight weeks. Due to relatively long cure times, the rate of tobacco component release during air curing may be relatively slow. Collection of the first aqueous solution during air curing processes may result in aqueous solutions with low concentrations of tobacco components, such as nicotine.

In a flue-curing process, the tobacco is hung and dried with heated air within an enclosed interior space, such as within a tobacco curing barn. The heated air may increase the rate of tobacco drying and increase the rate of release of tobacco components. Due to the increased rate of release of tobacco components, the first aqueous solution may be easier to collect during flue curing processes than during other curing processes.

The first aqueous solution may be collected throughout the curing process or during discrete periods of time in the curing process. Preferably, the first aqueous solution is collected during a time period in which relative humidity is high due to release of moisture from the tobacco.

Tobacco may be heated during curing. In some examples, air in contact with the curing tobacco is heated to a temperature in a range from 30 degrees Celsius to 80 degrees Celsius, such as from 35 degrees Celsius to 75 degrees Celsius. The temperature may be varied during the curing process.

A system for recovering concentrated nicotine from a tobacco curing process may include components associated with tobacco curing. For example, the system may comprise a heater to heat air in contact with the tobacco. The system may comprise a fan to circulate the air in contact with the tobacco. The system may comprise a heater and a fan.

The first aqueous solution may be collected in any suitable manner. For example, moisture released from tobacco during a curing process may be condensed to form the first aqueous solution and collected. A condenser may be used to produce a condensate from the moisture released from the tobacco. Any suitable condenser may be used. The condenser may comprise a surface that is maintained at a temperature below a temperature of an environment comprising the moisture released from the curing tobacco. The relatively cool temperature of the surface of the condenser promotes condensation of the moisture released from the tobacco to form the first aqueous solution. Preferably, the temperature of the surface of the condenser is below the dew point of the atmosphere with which the surface of the condenser is in contact. In some examples, the temperature of the surface of the condenser is maintained in a range from 1 degree Celsius to 10 degrees Celsius, such as from 2 degrees Celsius to 5 degrees Celsius.

The condenser may comprise condensation coils. A liquid having a temperature below the temperature in the environment may be passed through the coils to cool the external surface of the coils. For example, a refrigerant may be passed through the coils. The moisture released from the tobacco may condense on the coils to form the first aqueous solution.

The condenser may be position in any suitable location to contact the moisture released from the curing tobacco. The condenser may be placed in an enclosed space in which the tobacco is being cured. For example, the condenser may be placed in proximity to a ceiling of a tobacco barn. The condenser may be placed in communication with an exhaust vent that exits an enclosed space in which the moisture is released from the curing tobacco. The condenser may be placed in the enclosed space in which the tobacco is being cured and in proximity to an exhaust vent. The condenser may be placed inside the curing barn or outside the curing barn. One or more condensers may be used to condense the moisture released from the curing tobacco to form the first aqueous solution comprising nicotine.

The first aqueous solution may be collected in any suitable manner. For example, the condenser may comprise a collection surface below the surface on which the moisture is condensed. The collection surface may collect drops of the first aqueous solution that drip from the surface on which the moisture is condensed. The collection surface may funnel the collected first aqueous solution to a conduit. The conduit may carry the first aqueous solution from the collection surface to a collection vessel for retaining the collected first aqueous solution. The collection vessel may comprise a collection tank.

As an example, condenser and collection apparatus as described in International published patent application WO 2013/180918 may be employed to condense and collect the first aqueous solution.

The concentration of nicotine in the collected first aqueous solution may vary depending on, for example, the type of tobacco cured and the conditions in which the tobacco is cured. In some examples, the collected first aqueous solution may comprise from 100 parts per million nicotine to 500 parts per million nicotine, such as from 200 parts per million nicotine to 400 parts per million nicotine, or 300 parts per million nicotine.

The collected first aqueous solution comprising nicotine may be passed through a resin to sorb the nicotine. Any suitable resin may be used. Preferably, the resin is a strong cation resin. A strong cation resin is a resin that attracts and retains cations with little or no variation in ion exchange capacity over a large pH range, such as from pH of 2 to pH of 12. A strong cation resin may comprise a strong acid functional group. For example, the strong cation resin may comprise a sulphonyl group ($—SO_3^-$).

The resin may comprise any suitable polymer. Preferably, the polymer is capable of being functionalized to contain a strong acid moiety. For example, the polymer may be functionalized to comprise a sulphonyl group. In some examples, the resin comprises polystyrene.

Examples of commercially available strong cation resins that may be used to sorb nicotine from the first aqueous solution are AMBERLITE™ IR-120, SR1L Na, IR-122 Na, and FPC23 H ion exchange resins; BESTION® BC120, BC121, and BC122 ion exchange resins; LEWATIT® C 249 ion exchange resin; GC8 ion exchange resin available from ResinTech; and PUROLITE® C100 and C100E ion exchange resins.

Any suitable apparatus may comprise the strong cation resin. Preferably, an ion exchange column comprises the strong cation resin. The column may be packed with the resin, and the first aqueous solution may be passed through the column so that the nicotine may sorb to the resin.

Preferably, the resin in the column has sufficient capacity to sorb all the nicotine from the first aqueous solution. The sorption capacity of a resin in a column may depend on the degree of functionalization, such as the density of sulphonyl groups, of the resin and the packing density or amount of resin in the column.

More than one column may be used to sorb the nicotine from the first aqueous solution. One or more valves may be used to switch columns through with the first aqueous solution is fed when, for example, the cumulative amount of nicotine in the first aqueous solution that has passed through a column is close to, or has reached, the nicotine sorption capacity of the resin in the column.

The sorbed nicotine may be eluted from the resin by passing a second aqueous solution comprising ammonium hydroxide through the resin to which the nicotine is sorbed. Ammonium ions are exchanged for the nicotine to form a third aqueous solution comprising nicotine and ammonium hydroxide. The eluted nicotine in its neutral form at a pH value lower than 12.

The concentration of ammonium hydroxide in the second aqueous solution and the flow rate of the second aqueous solution through the resin are preferably suitable to result in a nicotine concentration in the third aqueous solution sufficient to cause separation of nicotine into high and low concentrations during subsequent settling. Preferably, the concentration of nicotine in the third aqueous solution is 1.3 percent by weight or greater. For example, the concentration of nicotine in the third aqueous solution may be from 2 percent by weight to 20 percent by weight. Preferably, the concentration of nicotine in the third aqueous solution is from 10 percent by weight to 20 percent by weight.

The concentration of ammonium hydroxide in the second aqueous solution may be from 2 percent by weight to 20 percent by weight, preferably from 5 percent by weight to 10 percent by weight. The flow rate of the second aqueous solution through the resin may depend on the concentration of the ammonium hydroxide. In some examples, the flow rate of the second aqueous solution through the resin is from 0.1 bed volumes per hour to 3 bed volumes per hour, such as from 0.5 bed volumes per hour to 2 bed volumes per hour. In some examples, the concentration of ammonium hydroxide in the second aqueous solution is from 5 percent by weight to 10 percent by weight, and the flow rate of the second aqueous solution through the resin is from 0.5 bed volumes per hour to 2 bed volumes per hour.

Ammonium hydroxide may be removed from the third aqueous solution in any suitable manner to produce a fourth aqueous solution comprising nicotine. Preferably, the ammonium hydroxide is removed from the third aqueous solution by an ammonia stripping process. Ammonium hydroxide is in equilibrium with ammonia in water according to the following equation: $NH_4^+ + OH^- \longleftrightarrow H_2O + NH_3$. Accordingly, removal of ammonia ($NH_3$) from the third aqueous solution drives the equilibrium towards production of more ammonia and removes the ammonium hydroxide from the third aqueous solution.

Ammonia may be stripped from the third aqueous solution in any suitable manner. For example, third aqueous solution may be contacted with a stream of gas in which ammonia is soluble. The stream of gas may comprise any suitable gas in which ammonia is soluble. In some examples, the gas is air or nitrogen ($N_2$).

The stream of gas may be contacted with the third aqueous solution in any suitable manner. For example, the stream of gas may be contacted with the third aqueous solution in a counter current or a crossflow manner.

For example, the third aqueous solution may be pumped into the top of a stripping column. The stripping column may be packed with appropriate material or objects, such as beads. In some examples, the column is filled with Raschig rings. The stream of gas may enter through openings in the bottom of the column. As droplets of the third aqueous solution fall through the column, the stream of gas may contact the droplets in a counter current manner and exit an opening in the top of the column to carry away ammonia.

The third aqueous solution, the gas stream, or the third aqueous solution and the gas stream may be heated to facilitate ammonia stripping. Preferably, the third aqueous solution is heated. Preferably, the third aqueous solution is heated prior to being introduced into the stripping column. The third aqueous solution may be heated to any suitable temperature. In some examples, the third aqueous solution is heated to a temperature from 20 degrees Celsius to 60 degrees Celsius.

The solution coming off the stripping column may be recirculated through the stripping column or subsequent stripping column until the concentration of ammonium hydroxide is sufficiently reduced to produce the fourth aqueous solution comprising nicotine. The fourth aqueous solution may comprise some residual ammonium hydroxide. Preferably, the fourth aqueous solution is free of, or substantially free of, ammonium hydroxide. For example, the concentration of ammonium hydroxide in the fourth aqueous solution may be sufficiently low such that the fourth aqueous solution has a pH of 9.5 or less or 9 or less.

The fourth aqueous solution may then be incubated at a temperature in a range from 60 degrees Celsius to 210 degrees Celsius to cause the fourth aqueous solution to separate into a fifth aqueous solution comprising a first concentration of nicotine and a sixth aqueous solution comprising a second concentration of nicotine. The first concentration of nicotine is greater than the second concentration of nicotine. The fourth aqueous solution may be incubated in any suitable manner to cause separation. For example, the fourth aqueous solution may be introduced into a settler for incubation and separation. The fourth aqueous solution may be introduced into any suitable settler. A suitable settler may be any container where the fourth aqueous solution may calmly rest.

The temperature within the settler may be controlled in any suitable manner. For example, the settler may comprise heating elements, such as resistive or inductive heating elements, to control temperature within the settler. The heating elements may be in a container in which the fourth aqueous solution is held, external to the container in which the fourth aqueous solution is held, or may be in and external to the container in which the fourth aqueous solution is held. The temperature of the settler may be controlled with a water jacket surrounding the container in which the fourth solution is held. Heated water may flow through the water jacket to control the temperature within the container. For purposes of the present disclosure, a settler for which temperature may be controlled is a "thermostatic" settler.

Preferably, the fourth aqueous solution is incubated at a temperature in a range from 60.8 degrees Celsius to 208 degrees Celsius to cause separation. Preferably, the fourth aqueous solution is incubated at a temperature below 100 degrees Celsius More preferably, the fourth aqueous solution is incubated at a temperature in a range from 80 degrees Celsius to 100 degrees Celsius, such as in a range from 80 degrees Celsius to 90 degrees Celsius.

The fourth aqueous solution may be incubated at an appropriate temperature for any suitable period of time to cause separation into the fifth aqueous solution comprising the first concentration of nicotine and the sixth aqueous solution comprising the second concentration of nicotine. For example, the fourth aqueous solution may be incubated for 10 minutes or more. In some examples, the fourth aqueous solution is incubated at the appropriate temperature for a duration from 10 minutes to 120 minutes, such as from 10 minutes to 60 minutes, or from 15 minutes to 30 minutes.

A system may comprise more than one settler so that a second settler may be filled with the fourth aqueous solution while the fourth aqueous solution is incubating in a first settler.

The first concentration of nicotine in the fifth aqueous solution is greater than the concentration of nicotine in the fourth aqueous solution, and the second concentration of nicotine in the sixth aqueous solution is less than the concentration of nicotine in the fourth solution. The first concentration of nicotine may be 70 percent by weight or greater, such as 75 percent by weight or greater.

The fifth aqueous solution may be collected to recover a concentrated nicotine from the tobacco curing process. For example, the fifth aqueous solution may be removed from the settler. For example, the fifth aqueous solution may be removed from the bottom of the settler through a stopper valve.

The sixth aqueous solution comprising the second concentration of nicotine may be recycled within the process. For example, the sixth aqueous solution may be added to the container in which the first aqueous liquid is stored, may be returned to a settler to be separated again, or may be added to the container in which the first aqueous liquid is stored and returned to a settler to be separated again.

Some water may be evaporated from the sixth aqueous solution to concentrate the nicotine to a similar concentration as the fourth aqueous solution prior to returning the sixth aqueous solution to the settler. The sixth aqueous solution may be heated to facilitate evaporation and nicotine concentration.

A seventh aqueous solution comprising nitric acid may be passed through the strong cation resin to regenerate the resin. Regeneration of resin may allow the resin to be reused, allowing additional collected first aqueous solution comprising moisture released from curing tobacco to be processed for nicotine concentration.

The concentration of nitric acid in the seventh aqueous solution and the flow rate of the seventh aqueous solution through the resin are preferably suitable to completely, or nearly completely, regenerate the resin. In some examples, the concentration of nitric acid in the seventh aqueous solution is from 1 percent by weight to 10 percent by weight, such as 5 percent by weight to 10 percent by weight, 3 percent by weight to 7 percent by weight, or 5 percent by weight. The flow rate of the seventh aqueous solution through the resin may depend on the concentration of the nitric acid. In some examples, the flow rate of the seventh aqueous solution through the resin is from 0.1 bed volumes per hour to 3 bed volumes per hour, such as from 0.5 bed volumes per hour to 3 bed volumes per hour. In some examples, the concentration of nitric acid in the seventh aqueous solution is from 5 percent by weight to 10 percent by weight, and the flow rate of the seventh aqueous solution through the resin is from 0.5 bed volumes per hour to 3 bed volumes per hour.

As the seventh aqueous solution is passed through the resin, hydronium ions ($H^+$) present in the seventh aqueous solution due to the nitric acid may exchange with the ammonium ions that sorbed to the resin after passing the second aqueous solution through the resin to elute the nicotine. Thus, the resin may be regenerated. As the seventh aqueous solution is passed through the resin, the nitric acid may react with the ammonium to produce an eighth aqueous solution comprising ammonium nitrate. The eighth aqueous solution may be stored in a by-product tank. The eighth aqueous solution may be used as a fertilizer.

The eight aqueous solution may comprise excess nitric acid. The eighth aqueous solution comprising excess nitric acid may be contacted with the gas stream comprising stripped ammonia. Contacting the eight aqueous solution comprising excess nitric acid with the gas comprising ammonia may result in removal of ammonia from the gas stream and production of additional ammonium nitrate.

After regenerating the column with the seventh aqueous solution, the column may be rinsed with water to remove excess nitric acid from the resin. The resulting aqueous solution may comprise residual nitric acid. This resulting solution may be contacted with the gas stream comprising stripped ammonia.

The gas stream with ammonia removed may be released to the environment or recycled.

A system for recovering concentrated nicotine from tobacco curing may comprise any suitable components. The system may comprise a condenser to condense moisture released from the tobacco during curing. The condensed moisture comprises nicotine. The condensed moisture may be the first aqueous solution.

The system may comprise a collection tank to store the condensed moisture.

The system may comprise an ion exchange column comprising a strong cation resin. The condensed moisture may be passed through the ion exchange column to sorb nicotine. The system may comprise a pump operatively coupled to the collection tank and the ion exchange column to pump the condensed moisture through the resin.

The system may comprise source of an aqueous solution comprising ammonium hydroxide. The aqueous solution comprising ammonium hydroxide may be the second aqueous solution. The system may comprise a pump operatively coupled to the source of the aqueous solution comprising ammonium hydroxide and to the ion exchange column. The pump may be configured to pump the ammonium hydroxide through the resin to elute the nicotine from the resin. The solution comprising the eluted nicotine, as well as ammonium hydroxide, may be the third aqueous solution.

The system may comprise a stripping apparatus configured to receive an aqueous solution comprising the nicotine and the ammonium hydroxide that has passed through the resin. The stripping apparatus may be operatively couplable to a source of gas. The stripping apparatus and gas may be configured to remove ammonia evolved from the ammonium hydroxide in the aqueous solution comprising the nicotine and the ammonium hydroxide. The ammonia may be carried away in a stream of the gas.

The stripping apparatus may be configured such that the gas flows in a counter current manner or a crossflow manner relative to the aqueous solution comprising the nicotine and the ammonium hydroxide. The stripping apparatus may comprise a column packed with appropriate material or objects, such as beads. In some examples, the column is filled with Raschig rings. In a counter current stripping apparatus, the stream of gas may enter through openings in the bottom of the column. As droplets of the third aqueous solution fall through the column, the stream of gas may contact the droplets in a counter current manner and exit an opening in the top of the column to carry away ammonia.

The resulting aqueous solution exiting the stripping apparatus, from which the ammonia has been removed, may be the fourth aqueous solution.

The system may comprise a storage tank configured to receive the aqueous solution comprising the nicotine and the ammonium hydroxide that has passed through the resin. The system may comprise a pump operatively coupled to the storage tank and the stripping apparatus. The pump may be configured to pump the aqueous solution comprising the nicotine and the ammonium hydroxide from the storage tank to the stripping apparatus.

The system may comprise a thermostatic settler operably coupled to the stripping apparatus and configured to receive an aqueous solution exiting the stripping apparatus. The aqueous solution exiting the stripping apparatus comprises the nicotine eluted from the ion exchange column from which the ammonium hydroxide has been removed in the stripping apparatus. The thermostatic separator may be configured to incubate the aqueous solution comprising the eluted nicotine from which the ammonium hydroxide has been removed at a temperature between 60 degrees Celsius and 210 degrees Celsius to cause separation of the incubated aqueous solution into an aqueous solution comprising a first concentration of nicotine and an aqueous solution comprising a second concentration of nicotine. The first concentration of nicotine is greater than the second concentration of nicotine. The aqueous solution comprising the first concentration of nicotine may be collected to recover concentrated nicotine. The aqueous solution comprising the first concentration of nicotine may be the fifth aqueous solution.

The system may further comprise a source of an aqueous solution comprising nitric acid. The system may comprise a pump operably couplable to the ion exchange column and the source of the aqueous solution comprising nitric acid. The pump may be configured to pump the aqueous solution comprising nitric acid through the strong cation resin. The nitric acid may elute ammonium from the resin to regenerate the resin. The nitric acid reacts with the ammonium to produce an aqueous solution comprising ammonium nitrate. The system may comprise by-product tank to which the aqueous solution comprising ammonium nitrate is directed. The aqueous solution comprising ammonium nitrate may be used as a fertilizer.

Components of the system may be made from any suitable material. Preferably, surfaces that contact the various aqueous solutions are compatible with the aqueous solutions. For example, compounds of the aqueous solutions preferably do not unintendedly react with surfaces of the system components that the aqueous solutions contact. Preferably, compounds of the aqueous solutions do not unintendedly sorb to surfaces of the system components that the aqueous solutions contact. Some plastic materials, such a polyethylene materials, polypropylene materials, and polyvinylchloride materials may sorb nicotine. While such plastic material may be used for aqueous solutions contacting surfaces, such plastic materials are not preferred.

As used herein, the singular forms "a," "an," and "the" also encompass embodiments having plural referents, unless the content clearly dictates otherwise.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

As used herein, "tobacco" means plant material, such as leaves, stems, or other portions of any of several plants belonging to the genus *Nicotiana*, such as of the species *N. tabacum*.

Preferably, tobacco includes leaves, stems or leaves and stems.

As used herein, an "aqueous solution" is a composition comprising water that is fluid at 20 degrees Celsius. The composition may be a solution, suspension, or the like.

As used herein, "elution" is the process of extracting one material for another by washing with a solvent. An example of elution is the exchange of a first ion for a second ion on an ion-exchange resin by washing the resin with a solution comprising a solvent and the second ion, wherein the first ion is soluble in the solvent, and removal of the first ion from the column in the solvent.

As used herein, "sorption" refers to retention of a molecule or ion in a gas or liquid to a surface or in a bulk phase. Sorption includes adsorption, absorption, and retention by chemical reaction. A molecule or ion retained by chemical reaction may be eluted provided that a subsequent chemical reaction may release the molecule during the elution process.

Below there is provided a non-exhaustive list of non-limiting examples. Any one or more of the features of these examples may be combined with any one or more features of another example, embodiment, or aspect described herein.

Example Ex1 A method for recovering concentrated nicotine from tobacco curing, comprising: (i) collecting a first aqueous solution comprising moisture released from curing tobacco, wherein the first aqueous solution comprises nicotine; (ii) passing the first aqueous solution through a strong cation resin to sorb the nicotine; (iii) passing a second aqueous solution comprising ammonium hydroxide through the resin to which the nicotine is sorbed to elute the nicotine from the resin and form a third aqueous solution comprising nicotine and ammonium hydroxide; (iv) removing ammonium hydroxide from the third aqueous solution to generate a fourth aqueous solution comprising nicotine; (v) incubating the fourth aqueous solution at a temperature between 60 degrees Celsius and 210 degrees Celsius to cause the fourth aqueous solution to separate into a fifth aqueous solution comprising a first concentration of nicotine and a sixth aqueous solution comprising a second concentration of nicotine, wherein the first concentration of nicotine is greater than the second concentration of nicotine; and (vi) collecting the fifth aqueous solution to recover the concentrated nicotine.

Example Ex2 A method according to Example Ex1, further comprising passing a seventh aqueous solution comprising nitric acid through the resin to regenerate the resin and elute the ammonium hydroxide and to generate an eighth aqueous solution comprising $NH_4NO_3$.

Example Ex3 A method according to Example Ex2, wherein the eighth aqueous solution comprises excess nitric acid.

Example Ex4 A method according to Example Ex2 or Ex3, wherein the step of removing ammonium hydroxide from the third aqueous solution comprises contacting the third aqueous solution with a stream of gas configured to carry ammonia from the third aqueous solution in the stream of gas, and wherein the stream of gas comprising the ammonia is brought into contact with the eighth aqueous solution.

Example Ex5 A method according to any one of Examples Ex1 to Ex4, wherein collecting the first aqueous solution comprises condensing the moisture from air in a curing barn.

Example Ex6 A method according to any one of Examples Ex1 to Ex5, wherein the strong cation resin comprises a polystyrene matrix.

Example Ex7 A method according to any one of Examples Ex 1 to Ex6, wherein the strong cation resin comprises a sulphonyl group.

Example Ex8 A method according to any one of Examples Ex1 to Ex7, wherein a concentration of ammonium hydroxide in the second aqueous solution is from 2 percent by weight to 20 percent by weight.

Example Ex9 A method according to any one of Examples Ex1 to Ex7, wherein a concentration of ammonium hydroxide in the second aqueous solution is from 5 percent by weight to 10 percent by weight.

Example Ex10A method according to any one of Examples Ex1 to Ex9, wherein the second aqueous solution is flowed through the resin at a rate from 0.1 bed volumes per hour to 3 bed volumes per hour.

Example Ex11A method according to any one of Examples Ex1 to Ex9, wherein the second aqueous solution is flowed through the resin at a rate from 0.5 bed volumes per hour to 2 bed volumes per hour.

Example Ex12 A method according to any one of Examples Ex1 to Ex11, wherein the third aqueous solution comprises a nicotine concentration of 1.3 percent by weight or greater.

Example Ex13 A method according to any one of Examples Ex1 to Ex12, wherein the third aqueous solution comprises a nicotine concentration of 5 percent by weight or greater.

Example Ex14 A method according to any one of Examples Ex1 to Ex13, wherein the third aqueous solution comprises a nicotine concentration from 5 percent by weight to 10 percent by weight.

Example Ex15 A method according to any one of Examples Ex1 to Ex14, wherein the ammonium hydroxide is removed from the third aqueous solution by a stripping process.

Example Ex16 A method according to Example Ex15, wherein the stripping process comprises contacting the third aqueous solution with a stream of gas in counter current to a flow direction of the third solution.

Example Ex17 A method according to Example Ex16, wherein the stream of gas comprises air or nitrogen gas.

Example Ex18 A method according to any one of Examples Ex15 to Ex17, wherein the removed ammonium hydroxide, or ammonia resulting from the stripping process, is contacted with the eight aqueous solution of Example Ex2 or Ex3.

Example Ex19 A method according to any one of Examples Ex1 to Ex18, wherein the fourth aqueous solution is incubated at the temperature between 80 degrees Celsius and 150 degrees Celsius.

Example Ex20 A method according to any one of Examples Ex1 to Ex19, wherein the fourth aqueous solution is incubated at a temperature between 80 degrees Celsius and 100 degrees Celsius.

Example Ex21 A method according to any one of Examples Ex1 to Ex20, wherein the fourth aqueous solution is incubated in a settler.

Example Ex22 A method according to Example Ex21, wherein the settler is a thermostatic settler.

Example Ex23 A method according to any one of Examples Ex1 to Ex22, wherein the sixth aqueous solution comprising the second concentration of nicotine is combined with the collected first aqueous solution.

Example Ex24 A system for recovering concentrated nicotine from tobacco curing, comprising: (i) a source of an aqueous solution comprising condensed moisture released from tobacco during curing, wherein the condensed moisture comprises nicotine; (ii) an ion exchange column comprising a strong cation resin through which the aqueous solution comprising the condensed moisture may be passed to sorb the nicotine; (iii) a first pump operatively coupled to a source of aqueous ammonium hydroxide and configured to pump the aqueous ammonium hydroxide through the strong cation resin to elute the nicotine from the resin; (iv) a stripping apparatus configured to receive an aqueous solution comprising the nicotine and the ammonium hydroxide that has passed through the resin, wherein the stripping apparatus is operatively couplable to a source of gas, wherein the stripping apparatus and gas are configured to remove ammonia evolved from the ammonium hydroxide in the aqueous solution comprising the nicotine and the ammonium hydroxide, wherein the ammonia is carried away in a stream of the gas; and (v) a thermostatic settler operably coupled to the stripping apparatus and configured to receive an aqueous solution exiting the stripping apparatus, wherein the aqueous solution exiting the stripping apparatus comprises the nicotine eluted from the ion exchange column from which the ammonium hydroxide has been removed in the stripping apparatus, wherein the thermostatic settler is configured to incubate the aqueous solution comprising the eluted nicotine from which the ammonium hydroxide has been removed at a temperature between 60 degrees Celsius and 210 degrees Celsius to cause separation of the incubated aqueous solution into an aqueous solution comprising a first concentration of nicotine and an aqueous solution comprising a second concentration of nicotine, wherein the first concentration of nicotine is greater than the second concentration of nicotine.

Example Ex25 A system according to Example Ex24, further comprising a condenser operatively coupled to the source of the aqueous solution comprising the condensed moisture, wherein the condenser is configured to condense the moisture released from the tobacco during a curing process.

Example Ex26 A system according to Example Ex24 or EX25, further comprising a second pump operably coupled to a source of an aqueous solution comprising nitric acid configured to pump the aqueous solution comprising nitric acid through the resin, wherein the nitric acid elutes ammonium hydroxide from the resin to regenerate the resin and reacts with the ammonium hydroxide to produce an aqueous solution comprising ammonium nitrate.

Example Ex27 A system according to Example Ex26, further comprising a valve configured to direct flow of the aqueous solution comprising the ammonium nitrate a by-product tank.

Example Ex28 A system according to Example Ex27, wherein the system is configured to bring the stream of gas that has exited the stripping apparatus to contact the aqueous solution comprising the ammonium nitrate.

Example Ex29 A system according to any one of Examples Ex24 to Ex28, further comprising a collection tank for retaining the condensed moisture.

Example Ex30 A system according to Example Ex29, further comprising a third pump operatively coupled to the collection tank and configured to pump the condensed moisture through the resin.

Example Ex31 A system according to any one of Examples Ex24 to Ex30, further comprising a storage tank configured to receive a solution comprising the eluted nicotine from the ion exchange column.

Example Ex32 A system according to Example Ex31, further comprising a valve configured to direct flow of the solution comprising the eluted nicotine from the ion exchange column to the storage tank.

Example Ex33 A system according to Example Ex32, wherein the valve configured to direct flow of the solution comprising the eluted nicotine from the ion exchange column to the storage tank is the valve according to Example Ex27 configured to direct flow of the aqueous solution comprising the ammonium nitrate a by-product tank.

Example Ex34 A system according to any one of Examples Ex24 to Ex33, further comprising a product tank operatively coupled to the thermostatic settler and configured to receive the aqueous solution comprising the first concentration of nicotine.

Examples will now be further described with reference to the figures in which.

Figure 5:
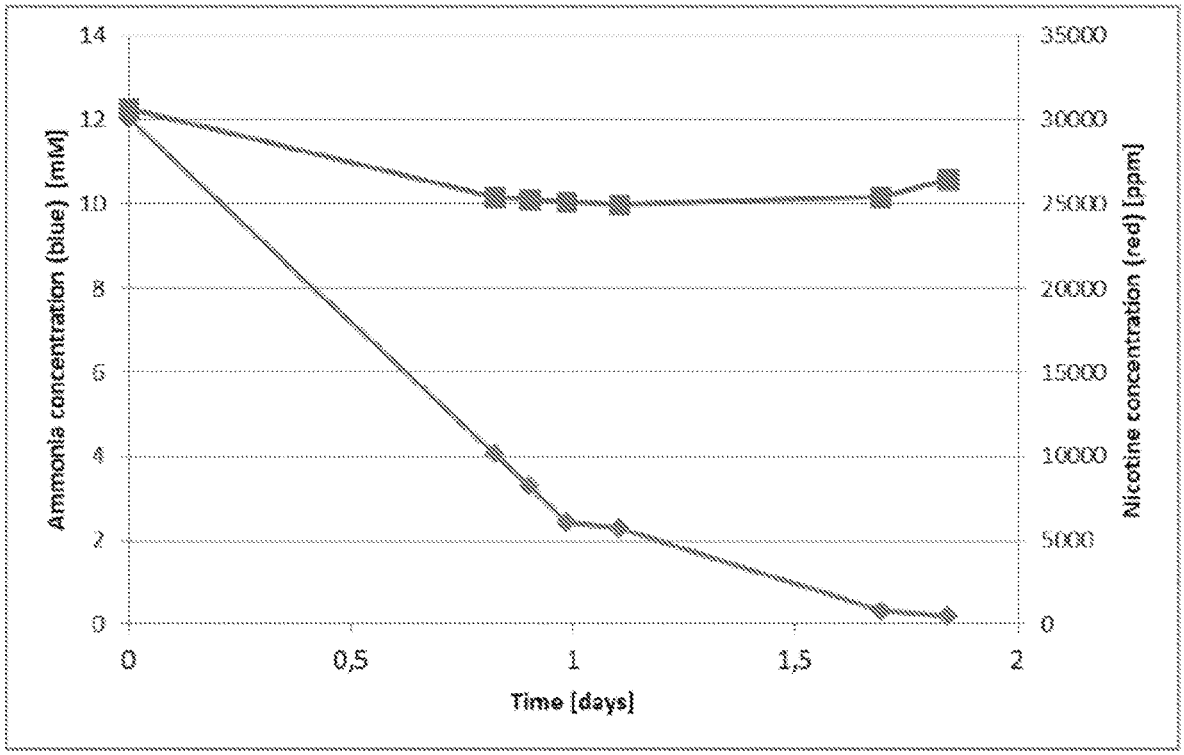
Figure 6:
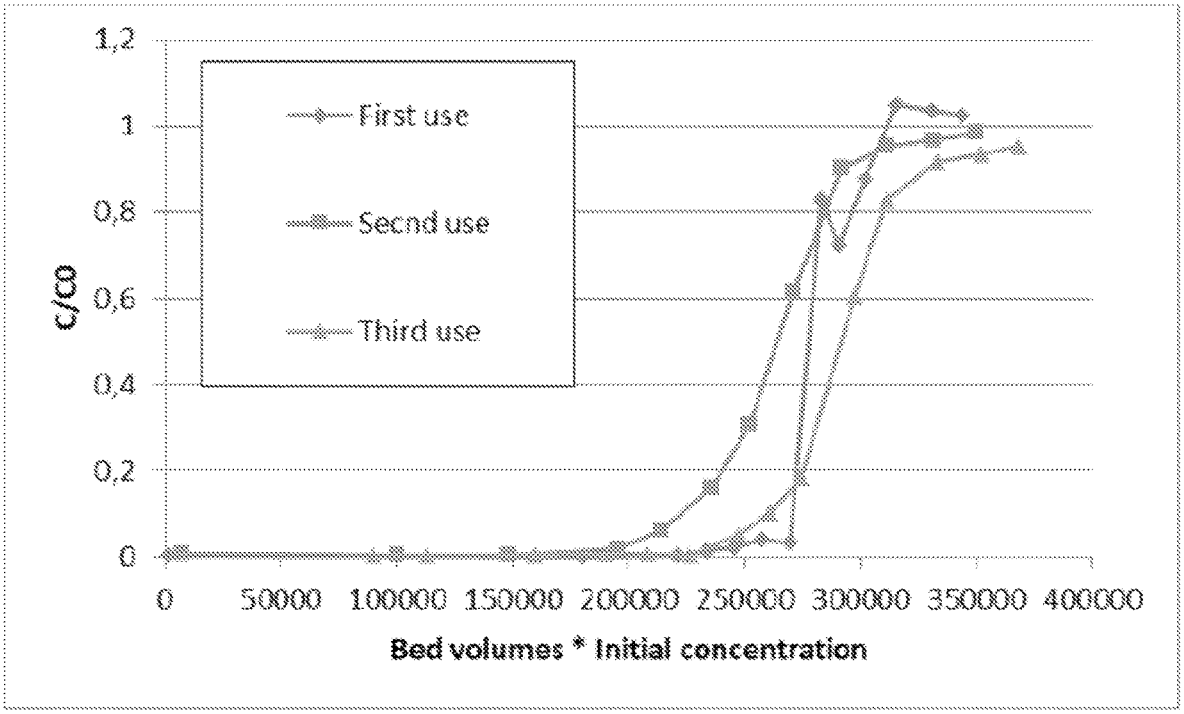

FIG. 5 is a graph of ammonia concentration and nicotine concentration in an aqueous solution comprising aqueous ammonia and nicotine over time as the ammonia is removed from the solution by a stripping process; and FIG. 6 is a graph of concentration of nicotine coming off an ion exchange column as a function of volume of an aqueous nicotine solution passed through the column after a first use, regeneration and a second use, and regeneration and a third use.

Figure 1:
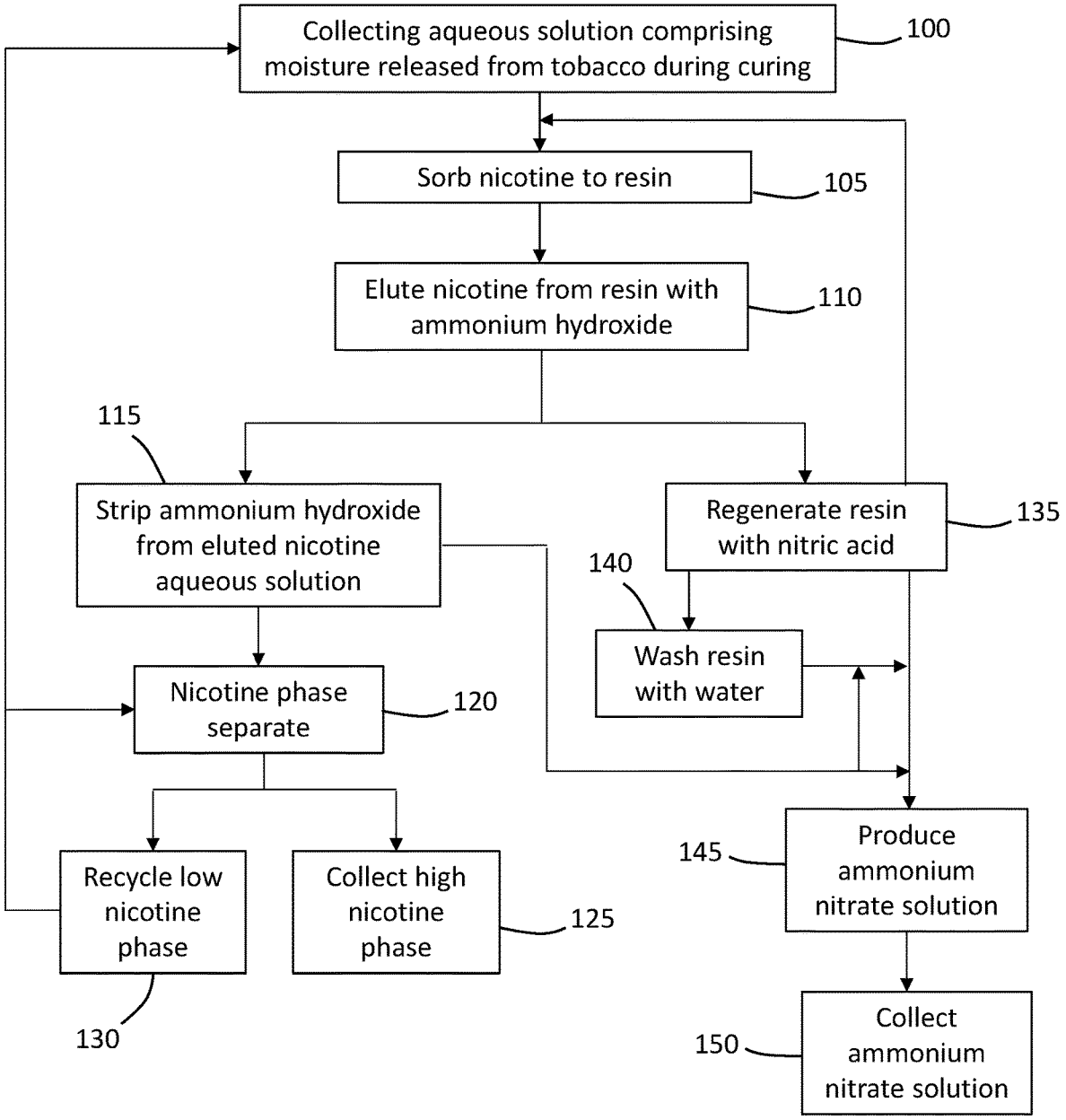
FIG. 1 is flow diagram illustrating a method according to an embodiment of the present invention.

FIG. 1 illustrates an overview of a method according to an embodiment of the present invention. The method includes collecting an aqueous solution comprising moisture released from tobacco during curing (100). The moisture may be condensed by a condenser to form the aqueous solution. The solution may be passed through a strong cation resin to sorb nicotine from the solution (105). The sorbed nicotine may be eluted from the resin by passing an aqueous solution comprising ammonium hydroxide through the resin (110). Ammonium ions will replace nicotine on the resin, and the solution comprising the eluted nicotine will comprise excess ammonium hydroxide. The ammonium hydroxide may be stripped from the eluted aqueous solution comprising nicotine (115). An ammonia stripping column may be used to strip ammonia, which results in removal of ammonium hydroxide, in a stream of gas. The aqueous solution comprising nicotine, from which the ammonium hydroxide has been removed, is settled to allow nicotine phase separation (120). When settled at an appropriate temperature, the nicotine will separate into a concentrated nicotine phase and a less concentrated aqueous phase. The high concentration nicotine phase is collected (125).

The low concentration nicotine phase may be recycled withing the process (130). For example, an aqueous solution comprising the low concentration nicotine phase may be resettled to cause further phase separation (120), may be combined with the collected aqueous solution comprising moisture released from tobacco during curing (100), or may be reintroduced at any other suitable step of the process. If the concentration of the aqueous solution comprising the low concentration nicotine phase is not sufficiently high to settle, some of the water may be evaporated to concentrate the nicotine prior to resettling.

The process may also include regenerating the resin with an aqueous solution comprising nitric acid (135) which results in the exchange for hydronium ions for ammonium ions and regenerated the resin. The regenerated resin may then be used to sorb nicotine (105) from additional aqueous solution comprising moisture released from tobacco during curing (100). Passing an aqueous solution comprising nitric acid through the resin results in the production of ammonium nitrate (145) due to reaction of the ammonium with nitrate. The produced ammonium nitrate may be collected (150) and used as fertilizer. The regenerated resin may be washed with water (140) to remove excess acid and lower the pH prior to the resin being reused. The water wash (140) may result in a solution comprising a low concentration of nitric acid.

A gas stream carrying ammonia from the stripping step (115) may be contacted with the resulting water solution from the water wash step (140) or resulting solution from the nitric acid resin regeneration step (135), which may produce additional ammonium nitrate (145) and remove ammonia from the gas stream prior to the gas stream being recycled or released to atmosphere. This may also deplete residual nitric acid.

As a result of the process depicted in FIG. 1, an aqueous solution comprising high concentration nicotine may be collected (125) from an aqueous solution comprising moisture released from tobacco during curing (100) with an aqueous solution comprising ammonium nitrate (150), which may be used as a fertilizer, as a by-product with little or no other waste produced. Thus, the process provides an environmentally friendly way to produce high concentration nicotine from an aqueous solution comprising moisture released from tobacco during curing.

Figure 2:
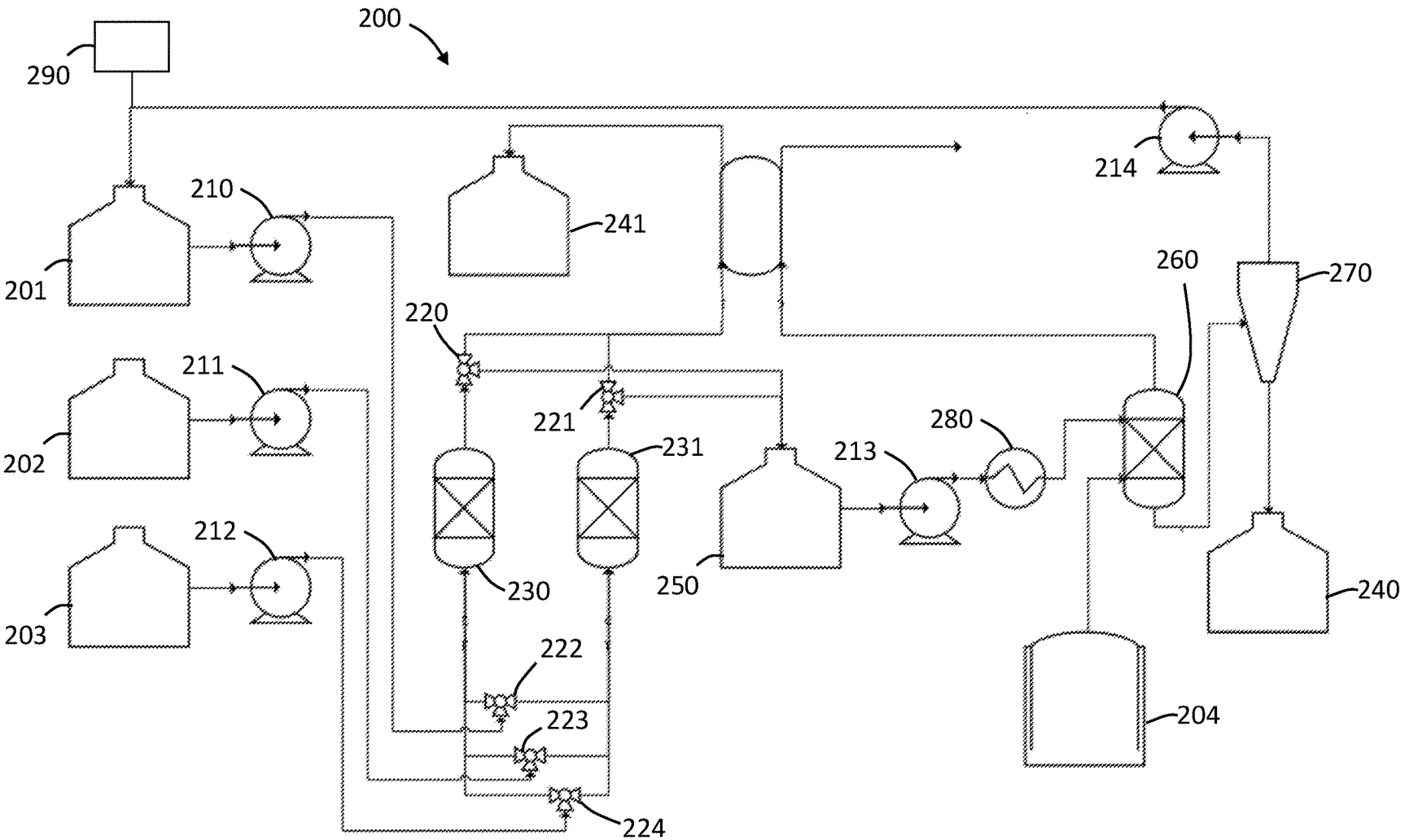
FIG. 2 is schematic block diagram illustrating a system according to an embodiment of the present invention.

FIG. 2 illustrates an overview of a system 200 according to an embodiment of the present invention. The system 200 includes source storage containers 201, 202, 203, 204, pumps 210, 211, 212, 213, 214, valves 220, 221, 222, 223, 224, ion exchange columns 230, 231, product storage containers 240, 241, an intermediate storage container 250, an ammonia stripping column 260, a thermostatic settler 270, a heat exchanger 280, and a condenser 290.

The condenser 290 may be positioned in a tobacco curing barn in suitable location to condense moisture released from tobacco as the tobacco is cured. The condensed moisture forms a first aqueous solution that may be collected and contained in storage container 201. Pump 210 is operatively coupled to storage container 201 and is configured to pump the first aqueous solution through the ion exchange columns 230, 231. Valve 222 directs the pumped first aqueous solution to the first ion exchange column 230 or the second ion exchange column 231. When the first ion exchange column 230 nears or reached maximum nicotine sorption capacity, valve 222 may direct the pumped first aqueous solution to the second ion exchange column 231. The ion exchange columns 230, 231 comprise a strong cation resin configured to sorb nicotine as the first aqueous solution is pumped through the ion exchange columns 230, 231.

Storage container 202 contains a second aqueous solution comprising ammonium hydroxide. Pump 211 is operatively coupled to storage container 202 and is configured to pump the second aqueous solution through the ion exchange columns 230, 231. Valve 223 directs the pumped second aqueous solution to the first ion exchange column 230 or the second ion exchange column 231 to elute nicotine from the ion exchange columns 230, 231 and form a third aqueous solution comprising nicotine and ammonium hydroxide. Valves 220, 221 direct the third aqueous solution to intermediate storage container 250.

Pump 213 is operatively coupled to the intermediate storage container 250 and in configured to pump the third aqueous solution through heat exchanger 280, which heats the third aqueous solution, and to the ammonia stripping column 260. As the third aqueous solution passes through the ammonia stripping column 260, a stream of gas from source storage container 204 contacts the third aqueous solution to remove ammonia, which generates a fourth aqueous solution comprising nicotine.

The fourth aqueous solution comprising nicotine flows to thermostatic settler 270 where the fourth aqueous solution is incubated for a sufficient time at a sufficient temperature to separate into a fifth aqueous solution comprising high concentration nicotine and a sixth aqueous solution comprising low concentration nicotine. The fifth aqueous solution is collected in product storage container 240.

Pump 214 is operatively coupled to the thermostatic settler and is configured to pump the sixth aqueous solution to the first storage container 201 for re-processing through the system 200.

Storage container 203 contains a seventh aqueous solution comprising nitric acid. Pump 212 is operatively coupled to storage container 203 and is configured to pump the seventh aqueous solution through the ion exchange columns 230, 231. Valve 224 directs the pumped seventh aqueous solution to the first ion exchange column 230 or the second ion exchange column 231 to regenerate the strong cation resins in the columns 230, 231 after second aqueous solution has passed through the columns 230, 231. As the seventh aqueous solution passes through the resin, hydronium ions are exchanged for ammonium ions, the ammonium ions are eluted, and an eighth aqueous solution is produced. The eighth aqueous solution comprises ammonium nitrate produced from a reaction of nitric acid with the aqueous ammonia and may contain excess nitric acid. Valves 220, 221 direct the seventh aqueous solution to product storage container 241. The seventh aqueous solution may be used as fertilizer.

As illustrated in FIG. 2, the stream of gas containing ammonia that exits the stripping column 260 may be brough into contact with the seventh aqueous solution so that the ammonia in the gas stream may react with excess nitric acid in the seventh aqueous solution to produce additional ammonium nitrate. Thus, ammonium in the gas stream may be depleted prior to venting the gas stream to the environment, and excess nitric acid in the seventh aqueous solution may be depleted prior to using the aqueous ammonium nitrate as fertilizer.

Non-limiting examples illustrating concentration of nicotine employing various steps of methods of the invention are provided below. The non-limiting examples reflect initial experimental testing to illustrate proof of concept of one or more aspects of the invention.

EXAMPLES

1. Nicotine Sorption to Strong Cation Resin

An aqueous solution was obtained by condensing atmosphere in a barn during a tobacco curing process. The condensed aqueous solution was spiked with additional nicotine to have a nicotine concentration of 2380 parts per million. The resulting solution was pumped upwards through a bed column of AMBERLITE™ IR-120 strong cation resin at a flow rate of 116.94 millilitres per minute, which corresponded to a linear velocity of 1.47 meters per hour.

Nicotine breakthrough was observed after 1475 minutes. The volume of nicotine solution passed through the resin to reach full charge of the resin was 25 litres. Based on these results, the resin capacity for nicotine was determined to be 1.44 millimoles per milliletre, and the resin was treated with 114 bed volumes (BV) of with the aqueous solution comprising nicotine.

Figure 3:
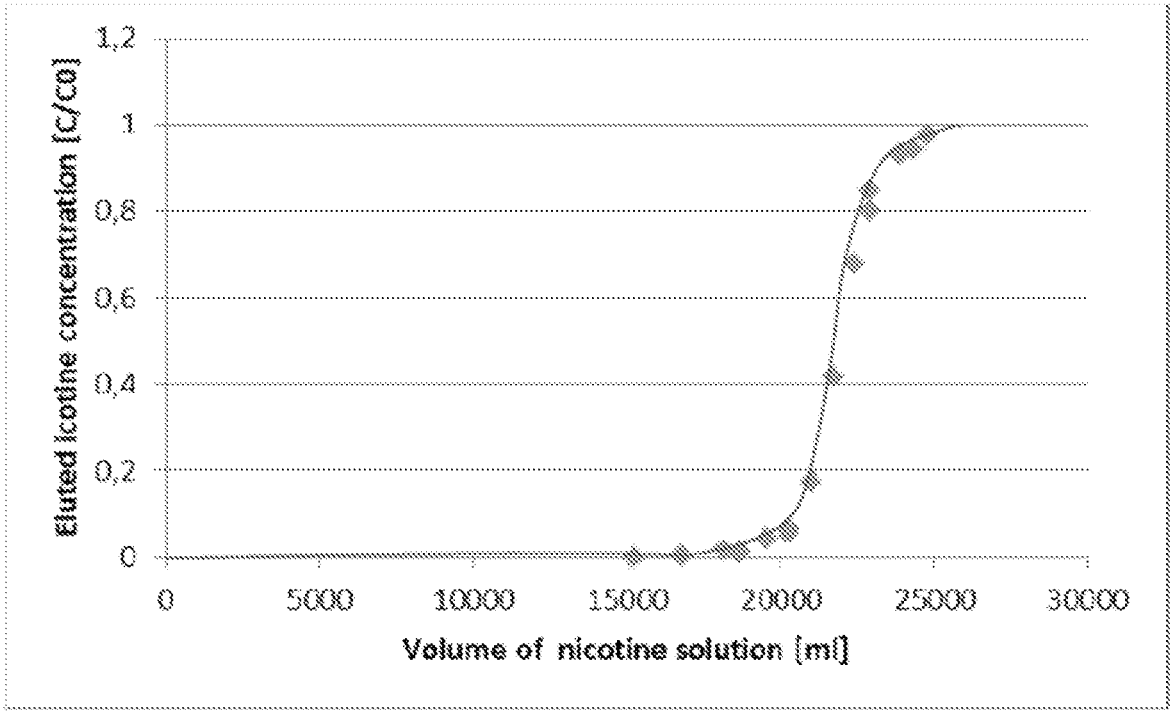
FIG. 3 is a graph of concentration of nicotine coming off an ion exchange column as a function of volume of an aqueous nicotine solution passed through the column.

Samples were taken at the outlet of the column as the solution was pumped through the column. The nicotine concentration of the samples was determined. The profile of nicotine concentration coming off the column as a function of volume of solution pumped through the column is illustrated in FIG. 3. Once the column reaches or nears capacity, nicotine is seen coming off the column.

2. Nicotine Release from Resin

The nicotine sorbed to the resin was eluted by passing through the resin a 7.51 percent by weight aqueous ammonia (ammonium hydroxide) solution. The process was performed filling the bed with successive volumes (BV) of aqueous ammonia and providing for 30 minutes of contact time between the aqueous ammonia solution and the resin. It is noted that similar results may be expected if operating in semi-continuous manner by passing the aqueous ammonia solution through the column at a flow rate corresponding with a similar residence time.

Figure 4:
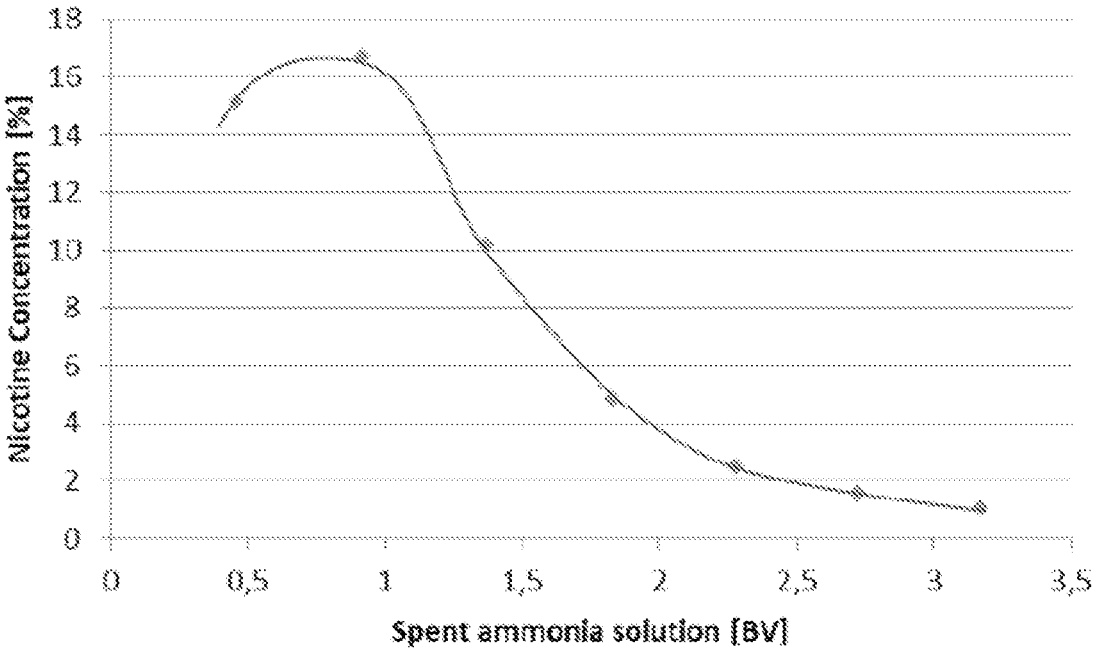
FIG. 4 is a graph of nicotine concentration eluted from an ion exchange column as a function of volume of an ammonium hydroxide solution passed through the column.

Samples were obtained from the column, and nicotine content of the samples was determined. As shown in FIG. 4, the concentration of nicotine eluted from the column peaked at 16 percent by weight nicotine. After the contacting the resin with 3.17 BVs of the aqueous ammonia solution, the nicotine concentration of the discharged solution was very low. Accordingly, 3.17 BV was considered to be the amount of aqueous ammonia solution required to recover all the nicotine that was sorbed to the resin in the column. The average nicotine concentration eluted from the column was determined to be 11.3 percent by weight as determined by integrating the area under the curve.

3. Stripping of Ammonia

Due to the large excess of aqueous ammonia used to elute the nicotine from the column, in the nicotine-rich solution eluted from the column contained substantial aqueous ammonia. Accordingly, the aqueous ammonia was removed from the resulting solution. The solution was passed through a stripping column filled with Raschig rings. The ammonia was removed by a stream of nitrogen gas. The process was carried out in semi-continuous way, recirculating the liquid solution and handing the nitrogen gas in continuous.

The ammonia concentration in the nitrogen gas stream exiting the stripping column was determined by high performance liquid chromatography (HPLC). FIG. 5 shows the results of the stripping process, illustrating that it is possible to remove essentially all the aqueous ammonia. The aqueous ammonia may be removed with minimal loss of nicotine from the solution.

4. Separation of Aqueous Nicotine Solution

The nicotine solution from which the aqueous ammonia was removed was settled to cause phase separation. The phase separation results when the settled solution is maintained at an appropriate temperature between 60.8 degrees Celsius and 208 degrees Celsius. The nicotine solution splits into two immiscible phases: a highly concentrated nicotine phase and a low concentrated aqueous phase. Because some water remains in the highly concentrated nicotine phase, this phase is still considered an aqueous solution for purposes of the present disclosure.

The nicotine solution from which the aqueous ammonia was removed was introduced into a thermostatic decanting funnel that was maintained at 90 degrees Celsius. After at least 10 minutes the nicotine separated into the two phases. The concentration of nicotine in the solution introduced into the decanting funnel, the concentration of nicotine in the separated aqueous phase, and the concentration of nicotine in the separated nicotine phase was determined. Nicotine concentration was determined by a spectrophotometry technique using a wavelength of 258.5 nanometres. The results were confirmed by HPLC. The results are presented in Table 1.

TABLE 1

Nicotine concentrations associated with separation of aqueous nicotine solution

| | Concentration (weight percent) | Mass (grams) |
|---|---|---|
| Initial solution | 11.30 | 430.95 |
| Separated aqueous phase | 8.66 | 408.09 |
| Separated nicotine phase | 77.71 | 13.63 |

The separated nicotine phase contained a concentration of nearly 80 percent by weight nicotine, while separated aqueous phase contained 8.66 percent by weight nicotine.

Two additional trials were run. The results are shown in Table 2.

TABLE 1

Nicotine concentrations associated with separation of aqueous nicotine solution

| | Experiment 1 (concentration) | Experiment 2 (concentration) |
|---|---|---|
| Initial | 7.2 | 9.6 |
| Aqueous | 6.7 | 7.3 |
| Nicotine | 75.8 | 71.6 |

Because a substantial amount of nicotine remained in the separated aqueous phase, the aqueous phase would preferably be recycled to an earlier stage of the process. If the separated aqueous phase was recirculated to the thermostatic settler, it may be beneficial to increase the concentration of nicotine in the solution by evaporating some of the water until the concentration is similar to the concentration of nicotine in the originally introduced solution.

5. Regeneration of the Resin

Once the nicotine was eluted form the resin, the resin is in the $NH_4^+$-form was converted again to the $H^+$-form for being reused in another nicotine uptake cycle. While different mineral acids may be used to regenerate the resin, nitric acid was selected because it may react with aqueous ammonia to generate ammonium nitrate, which may be used as a fertilizer. The fertilizer may be applied to tobacco crops that may be in proximity to a curing barn in which the initial aqueous solution comprising nicotine is collected during tobacco curing.

Resin regeneration was performed using a solution of 5 percent by weight nitric acid, which was passed through the column (3 BV) in 30 min. The column was then rinsed with water to remove excess nitric acid. The solution resulting from the rinse may contain residual nitric acid, which may be used to convert stripped ammonium to ammonium nitrate.

The regenerated resin was then tested for its ability to sorb nicotine and elute nicotine, as indicated above in Examples 1 and 2. Three cycles sorption, elution, and regeneration were performed. The concentration of eluted nicotine during each cycle is shown in FIG. 6.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±2% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. A method for recovering concentrated nicotine from tobacco curing, comprising:

collecting a first aqueous solution comprising moisture released from curing tobacco, wherein the first aqueous solution comprises nicotine;

passing the first aqueous solution through a strong cation resin to sorb the nicotine;

passing a second aqueous solution comprising ammonium hydroxide through the resin to which the nicotine is sorbed to elute the nicotine from the resin and form a third aqueous solution comprising nicotine and ammonium hydroxide;

removing ammonium hydroxide from the third aqueous solution to generate a fourth aqueous solution comprising nicotine;

incubating the fourth aqueous solution at a temperature between 60 degrees Celsius and 210 degrees Celsius to cause the fourth aqueous solution to separate into a fifth aqueous solution comprising a first concentration of nicotine and a sixth aqueous solution comprising a second concentration of nicotine, wherein the first concentration of nicotine is greater than the second concentration of nicotine; and collecting the fifth aqueous solution to recover the concentrated nicotine.

2. The method according to claim 1, further comprising passing a seventh aqueous solution comprising nitric acid through the resin to regenerate the resin and elute the ammonium hydroxide and to generate an eighth aqueous solution comprising $NH_4NO_3$.

3. The method according to claim 2, wherein the eighth aqueous solution comprises excess nitric acid.

4. The method according to claim 2, wherein the step of removing ammonium hydroxide from the third aqueous solution comprises contacting the third aqueous solution with a stream of gas configured to carry ammonia from the third aqueous solution in the stream of gas, and wherein the stream of gas comprising the ammonia is brought into contact with the eighth aqueous solution.

5. The method according to claim 1, wherein a concentration of ammonium hydroxide in the second aqueous solution is from 5 percent by weight to 10 percent by weight.

6. The method according to claim 1, wherein the second aqueous solution is flowed through the resin at a rate from 0.5 bed volumes per hour to 3 bed volumes per hour.

7. The method according to claim 1, wherein the third aqueous solution comprises a nicotine concentration of 5 percent by weight or greater.

8. The method according to claim 1, wherein the third aqueous solution comprises a nicotine concentration from 5 percent by weight to 10 percent by weight.

9. The method according to claim 1, wherein the ammonium hydroxide is removed from the third aqueous solution by a stripping process.

10. The method according to claim 9, wherein the stripping process comprises contacting the third aqueous solution with a stream of gas in counter current to a flow direction of the third solution.

11. The method according to claim 10, wherein the stream of gas comprises air or nitrogen gas.

12. The method according to claim 2, wherein the ammonium hydroxide is removed from the third aqueous solution by a stripping process and wherein the removed ammonium hydroxide, or ammonia resulting from the stripping process, is contacted with the eight aqueous solution.

13. The method according to claim 1, wherein the fourth aqueous solution is incubated at a temperature between 80 degrees Celsius and 150 degrees Celsius.

14. The method according to claim 1, wherein the sixth aqueous solution comprising the second concentration of nicotine is combined with the first aqueous solution.

15. A system for recovering concentrated nicotine from tobacco curing, comprising:

a condenser to condense moisture released from tobacco during curing, wherein the condensed moisture comprises nicotine;

an ion exchange column comprising a strong cation resin through which the condensed moisture may be passed to sorb the nicotine;

a first pump operatively couplable to a source of aqueous ammonium hydroxide and the ion exchange column and configured to pump the aqueous ammonium hydroxide through the strong cation resin to elute the nicotine from the resin;

a stripping apparatus configured to receive an aqueous solution comprising the nicotine and the ammonium hydroxide that has passed through the resin, wherein the stripping apparatus is operatively couplable to a source of gas, wherein the stripping apparatus and gas are configured to remove ammonia evolved from the ammonium hydroxide in the aqueous solution comprising the nicotine and the ammonium hydroxide, wherein the ammonia is carried away in a stream of the gas; and a thermostatic settler operably coupled to the stripping apparatus and configured to receive an aqueous solution exiting the stripping apparatus, wherein the aqueous solution exiting the stripping apparatus comprises the nicotine eluted from the ion exchange column from which the ammonium hydroxide has been removed in the stripping apparatus, wherein the thermostatic settler is configured to incubate the aqueous solution comprising the eluted nicotine from which the ammonium hydroxide has been removed at a temperature between 60 degrees Celsius and 210 degrees Celsius to cause separation of the incubated aqueous solution into an aqueous solution comprising a first concentration of nicotine and an aqueous solution comprising a second concentration of nicotine, wherein the first concentration of nicotine is greater than the second concentration of nicotine.

* * * * *